US006030683A

United States Patent [19]

Chitrangad

[11] Patent Number: 6,030,683

[45] Date of Patent: Feb. 29, 2000

[54] ARAMID BALLISTIC STRUCTURE

[75] Inventor: Chitrangad, Midlothian, Va.

[73] Assignee: E. I. du Pont de Nemours and Company, Wilmington, Del.

[21] Appl. No.: 08/636,446

[22] Filed: Apr. 23, 1996

[51] Int. Cl.[7] ..... B32B 1/04

[52] U.S. Cl. ..... 428/74; 442/255; 442/259; 442/295; 442/301; 428/911; 162/157.3

[58] Field of Search ..... 428/74, 911; 442/235, 442/259, 295, 301; 162/157.3

[56] References Cited

U.S. PATENT DOCUMENTS

| | | | |
|---|---|---|---|
| D. 327,217 | 6/1992 | Wallace . | |
| 3,320,619 | 5/1967 | Lastnik et al. . | |
| 4,515,656 | 5/1985 | Memeger . | |
| 4,574,105 | 3/1986 | Donovan . | |
| 4,729,921 | 3/1988 | Tokarsky . | |
| 5,028,372 | 7/1991 | Brierre et al. | 264/148 |
| 5,084,136 | 1/1992 | Haines et al. | 162/9 |
| 5,171,402 | 12/1992 | Haines et al. | 162/157.3 |

FOREIGN PATENT DOCUMENTS

| | | |
|---|---|---|
| 0 441 338 A2 | 6/1991 | European Pat. Off. . |
| 35 15 726 A1 | 11/1986 | Germany . |
| 2 198 824 | 6/1988 | United Kingdom . |
| 87/03674 | 6/1987 | WIPO . |
| 91/17408 | 11/1991 | WIPO . |

*Primary Examiner*—Terrel Morris
*Attorney, Agent, or Firm*—Robert J. Shafer

[57] ABSTRACT

An aramid ballistic protection construction is disclosed with a combination of woven para-aramid fiber sheets and compressed pulp sheets. The construction exhibits improved wearer comfort and increased flexibility, with a level of ballistics protection nearly equal to that provided by an equivalent areal density of woven sheets, alone.

5 Claims, 1 Drawing Sheet

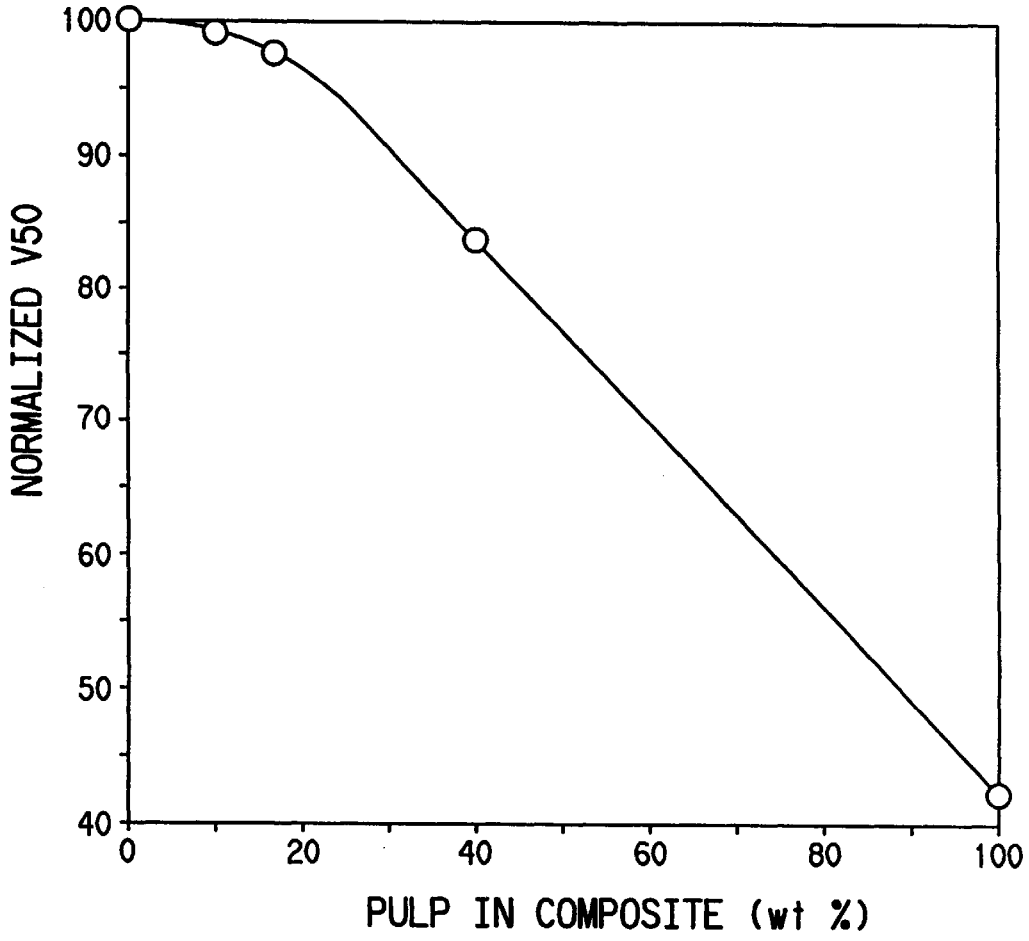
100
90
80
70
60
50
40
NORMALIZED V50
0
20
40
60
80
100
PULP IN COMPOSITE (wt %)

ARAMID BALLISTIC STRUCTURE

BACKGROUND OF THE INVENTION

1. Field of the Invention

This invention relates to so-called soft ballistic protection constructions. Garments can be made using such constructions which exhibit improved flexibility, workability, and comfort levels while, at the same time, affording satisfactory ballistic protection. These constructions have generally been made using several layers of materials which layers, if taken alone, would each exhibit some degree of ballistic protection. This invention, however, requires at least one layer of pulp material, individual particles of which are very short and individual layers of which, by themselves, provide little, if any, ballistic protection.

2. Description of the Prior Art

U.S. Pat. No. 4,574,105, issued Mar. 4, 1986 on the application of Donovan, discloses penetration resistant constructions made from layers of woven and non-woven fibers of poly(p-phenylene terephthalamide) and polyamide. Various combinations of layers of the fibers are disclosed and tested and various ballistic protection results are reported. In all of the nonwoven layers, however, there is use of only staple fibers which have been compressed into a felt by needling and which have a length of about 10 centimeters.

United Kingdom Patent Applicaton No. 2,198,824 published Jun. 22, 1988, discloses a flexible armour which includes layers of compressed felt for wearer comfort and for improved protection. The compressed felts are disclosed to be preferably aramids and they are made up of staple fibers from 5 to 10 centimeters long.

German Patent Application No. 3,515,726, laid open Nov. 6, 1986, discloses a material exhibiting high resistance to penetration by projectiles wherein the material is made using at least two types of superposed aramid fiber layers. One of the types of layers is woven and the other is nonwoven and both types of layers are made from aramid yarns of either continuous or staple fibers.

SUMMARY OF THE INVENTION

The present invention relates to a fabric construction for ballistic protection comprising at least two layers of woven yarn and at least one layer of pulp positioned therebetween, wherein the pulp is from 5 to 20 weight percent of the construction based on weight of the layers of woven yarn. The layers of woven yarn in the construction of this invention generally have a total areal density of 1.5 to 24 kilograms per square meter; and individual particles of pulp in the at least one layer of pulp generally have a length of 0.1 to 8 millimeters, a diameter of 0.1 to 15 micrometers, and an average surface area of more than 3 square meters per gram.

In preferred embodiments of the construction, the woven yarn and the pulp are aramid; and in especially preferred embodiments, the woven yarn and the pulp are para-aramid.

BRIEF DESCRIPTION OF THE DRAWINGS

The FIGURE is a graphical representation of normalized ballistic performance of fabric ballistic constructions as a function of pulp contained in the construction.

DETAILED DESCRIPTION

By "aramid" is meant a polyamide wherein at least 85% of the amide (—CO—NH—) linkages are attached directly to two aromatic rings. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

Para-aramids are the most preferred polymers in fibers of this invention and poly (p-phenylene terephthalamide)(PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which permit preparation of anisotropic spin dopes. Preparation of PPD-T is described in U.S. Pat. Nos. 3,869,429; 4,308,374; and 4,698,414.

The fabric construction of this invention can include fabrics of any weave usually used for ballistics purposes. There is no particular restriction or preference, either in weave pattern or in fabric weight. Among acceptable weave patterns can be mentioned plain weave, 2×2 basket weave, 8×8 basket weave, crowfoot weave, some satin weaves, and the like. Yarn counts in these fabrics can range from 5×5 to 20×20 ends per centimeter; and fabric weights from 200 to 700 grams per square meter.

The fabric construction of this invention includes layers of woven yarn and a layer of pulp situated therebetween. Pulp is a product made by refining (or grinding) short lengths of fibers to crush and fibrillate the fibers to yield splayed ends and hair-like fibrils extending from the fiber trunk. The short fibers or floc, which serves as a starting material, are about 3 to 13 millimeters in length and generally have a diameter of about 10 to 20 micrometers. After refining, the individual pulp particles are about 0.1 to 8 millimeters long, may have diameters from 0.1 to 15 micrometers, and have fibrils 0.1 to 10 micrometers in diameter. Pulp of this invention is preferably made from aramid, more preferably PPD-T. Pulp is discussed in U.S. Pat. Nos. 5,171,402; 5,084,136; and 5,028,372.

Pulp is used for practice of this invention as an improvement over staple fibers. Staple fibers are fibers about 2 to 20 centimeters in length which have been cut from a continuous tow of fiber material. Pulp particles, as stated, have fibrils and fibrillated ends and the fibrils and fibrillated ends cause pulp particles to become entangled and interlocked with each other to yield a uniform paper structure. Staple fibers, on the other hand, are more difficult to make into a uniform sheet-form. Pulp particles can be made into cohesive sheets by simple paper-making processes, while staple fibers must be carded, dispersed, air-laid, cross-lapped, and consolidated; and to make the cross-lapped layers stay together, the material must be needle-punched or hydro-entangled.

The construction of this invention utilizes at least one layer of pulp and the pulp is present as a relatively uniform and condensed layer. Preferably, the pulp is made into a thick paper by means of any well-known paper-making process. The thickness of such paper should be 0.5 to 5 millimeters and the areal density should be about 100 to 1000 grams per square meter.

While such is not necessary, the pulp sheets of this invention may include minor amounts of polymeric binder materials, such as, for example, polyvinyl alcohol, polyolefins, such as polyethylene, latexes of polymers such as polyvinyl chloride, and the like. Other polymeric binder materials can be used for specific needs, such as the use of heat-resistant polymers as binders for high temperature applications. Such binder materials are used in amounts effective to assist in holding the pulp particles together, not generally more than ten weight percent, based on weight of the pulp. Such binder materials are not necessary for practice of the invention or for use of the fabric construction of this invention; but may be useful in improving the handling characteristics of the pulp layers while assembling the fabric construction. While the pulp layers in combination with the woven layers of this invention provide a high degree of ballistics protection, the pulp layers, taken alone, are very weak and subject to being broken during handling.

The nonwoven layers of pulp, whether made by felting processes or papermaking processes, must be positioned between layers of woven yarn in the fabric construction of this invention. Due to the inherent tensile weakness of the pulp layers, the fabric construction must have at least a facing layer of woven yarn and a backing layer of woven yarn. There are often several additional layers of woven yarn and there are often several additional layers of pulp. Aside from the requirement that the fabric construction must have facing and backing layers of woven yarn, additional layers of woven yarn and additional layers of pulp can be arranged in the construction in any manner that is convenient or desired. For example, the woven layers and pulp layers can be alternated through the thickness of the fabric construction. For fabric constructions of moderate thickness—up to about 35 total layers of woven yarn and pulp—it is preferred that the layers adjacent to the facing layer should be pulp layers and the layers adjacent to the backing layer should be woven yarn layers.

The layers of pulp must be held in position in the fabric construction and held together as individual layers; and this can be accomplished by tight and close containment by the facing and backing layers or by sewing pulp layers to woven layers or by other means. In fabric constructions of moderate thickness, it is preferred that the entire fabric construction be stitched together through all of the layers. The stitching can be at random or in a pattern, and is commonly in a diamond pattern with parallel stitching lines about 2–5 centimeters apart.

It is one of the very surprising aspects of this invention that the ballistic protection offered by pulp sheets alone is very low to non-existent; but that pulp sheets can be used in combination with woven sheets, in amounts of up to as much as twenty weight percent of the woven sheets, with less than 5 percent loss in the ballistic limit of an equivalent areal density of woven sheets, alone.

Referring to the FIGURE, data from the Example herein have been expressed graphically to show that the fabric construction of this invention, having aramid pulp content of as much as twenty weight percent, maintains nearly 95% of the ballistic performance which would be realized by use of aramid fabrics with no pulp content.

TEST METHODS

Ballistic Limit. Ballistic tests of the composite samples were conducted in accordance with MIL-STD-662e as follows: A lay-up to be tested is placed in a sample mount to hold the lay-up taut and perpendicular to the path of test projectiles. The projectiles are Type I, 5.56 millimeter (22 caliber), 1.1 gram (17-grain) fragment simulating projectiles (MIL-H-44099), except where indicated otherwise, and are propelled from a test barrel capable of firing the projectiles at different velocities. The first firing for each lay-up is for a projectile velocity estimated to be the likely ballistic limit ($V_{50}$). When the first firing yields a complete lay-up penetration, the next firing is for a projectile velocity of about 15 meters per second (50 feet per second) less in order to obtain a partial penetration of the lay-up. On the other hand, when the first firing yields no penetration or partial penetration, the next firing is for a velocity of about 15 meters per second (50 feet per second) more in order to obtain a complete penetration. After obtaining one partial and one complete projectile penetration, subsequent velocity increases or decreases of about 15 meters per second (50 feet per second) are used until enough firings are made to determine the ballistic limit ($V_{50}$) for that lay-up.

The ballistic limit ($V_{50}$) is calculated by finding the arithmetic mean of an equal number of three of the highest partial penetration impact velocities and three of the lowest complete penetration impact velocities, provided that there is not more than 38 meters per second (125 feet per second) between the highest and lowest individual impact velocities.

Among many other uses, the fabric construction of this invention finds application in ballistic curtains and shelters, personnel ballistic protection in the form of garments and soft armor, and the like.

EXAMPLES

Test materials were constructed using combinations of woven sheets and pulp sheets of para-aramid materials as set out in the Table below. The test materials were evaluated for Ballistic Limit. The sheets were rectangular and were about 28 centimeters by 36 centimeters. Each combination of sheets was stitched on all edges and in both directions diagonally to hold the sheets together. No binder material was used in the pulp sheets.

"Woven sheets" are sheets of poly(p-phenylene terephthalamide) 1363 dtex (1500 denier) yarn sold by E. I. du Pont de Nemours and Company under the tradename "Kevlar" K-29 woven in a 2×2 basket weave at 13.8×13.4 ends per centimeter (35×34 ends per inch). "Pulp sheets" are sheets compacted from poly(p-phenylene terephthalamide) pulp sold by E. I. du Pont de Nemours and Company under the tradename "Kevlar" IF-305; the pulp having an arithmetic average particle length of about 0.45 mm and a surface area of about 7.5 square meters per gram.

TABLE

| Configuration | % Pulp | Areal Den. ($kg/m^2$) | $V_{50}$ (mps) | $V_{50}$ normalized* |
|---|---|---|---|---|
| 10 woven sheets | 0 | 4.84 | 503 | 100 |
| 1 woven sheet, 2 pulp sheets, and 8 woven sheets | 10 | 4.74 | 489 | 99.3 |
| 2 woven sheets, 6 pulp sheets, and 4 woven sheets | 40 | 4.84 | 421 | 83.7 |
| 15 pulp sheets | 100 | 4.84 | ~211 | 42 |
| 12 woven sheets | 0 | 5.82 | 538 | 100 |
| 1 woven sheet, 4 pulp sheets, and 9 woven sheets | 16.7 | 5.82 | 526 | 97.8 |

*"normalized" means that the $V_{50}$ is reported as a percentage of the $V_{50}$ of an all woven fabric structure of the same areal density.

What is claimed is:

1. A fabric construction for ballistic protection comprising at least two layers of woven para-aramid yarn and at least one layer of pulp positioned therebetween;

wherein the pulp is from 5 to 20 weight percent of the construction based on weight of the layers of woven yarn.

2. The construction of claim 1 wherein the layers of woven yarn have a total areal density of 1.5 to 24 kilograms per square meter.

3. The construction of claim 1 wherein individual particles of the pulp have a length of 0.1 to 8 millimeters, a diameter of 0.1 to 15 micrometers, and an average surface area of more than 3 square meters per gram.

4. The construction of claim 1 wherein the pulp is aramid.

5. The construction of claim 1 wherein the pulp is para-aramid.

* * * * *